United States Patent [19]

Boblett

[11] 4,334,229

[45] Jun. 8, 1982

[54] LEAKY WAVEGUIDE CONTINUOUS SLOT ANTENNA

[75] Inventor: Arthur P. Boblett, Riverside, Calif.

[73] Assignee: The United States of America as represented by the Secretary of the Navy, Washington, D.C.

[21] Appl. No.: 775,997

[22] Filed: Nov. 12, 1968

[51] Int. Cl.[3] ..... H01Q 13/00

[52] U.S. Cl. ..... 343/767

[58] Field of Search ..... 343/767, 771, 746, 768

[56] References Cited

U.S. PATENT DOCUMENTS 2,937,373 5/1960 Carter ..... 343/771

2,990,547 6/1961 McDougal ..... 343/767

*Primary Examiner*—Theodore M. Blum

*Attorney, Agent, or Firm*—Robert F. Beers; Joseph M. St. Amand

[57] ABSTRACT

A continuous slot leaky waveguide antenna for radiating radio frequency so that the far E-field elevation pattern will closely follow a predicted pattern.

4 Claims, 2 Drawing Figures

LEAKY WAVEGUIDE CONTINUOUS SLOT ANTENNA

The invention herein described may be manufactured and used by or for the Government of the United States of America for governmental purposes without the payment of any royalties thereon or therefor.

The elevation patterns of previous type continuous slot antennas are not accurately predictable because many of the dimensions and physical quantities involved were not considered or unsatisfactorily approximated. Phazing control, and thus pattern prediction was partially achieved by combining a variable slot offset with a variable "a" dimension of the waveguide, in order to fabricate such an antenna three contours, one for the slot and two for the edges of the waveguide were required to be formed. Previous antennas of this general type were limited to designs based on standard or well known current distribution functions along the aperture.

In the present invention only two curved contours are necessary to build an antenna. The far E-field azimuthal pattern is precisely predictable from equations which closely represent the true physical situation.

Other objects and many of the attendant advantages of this invention will become readily appreciated as the same becomes better understood by reference to the following detailed description when considered in connection with the accompanying drawings wherein.

Referring now to the drawings like reference characters refer to like parts in each of the figures.

Figure 1:
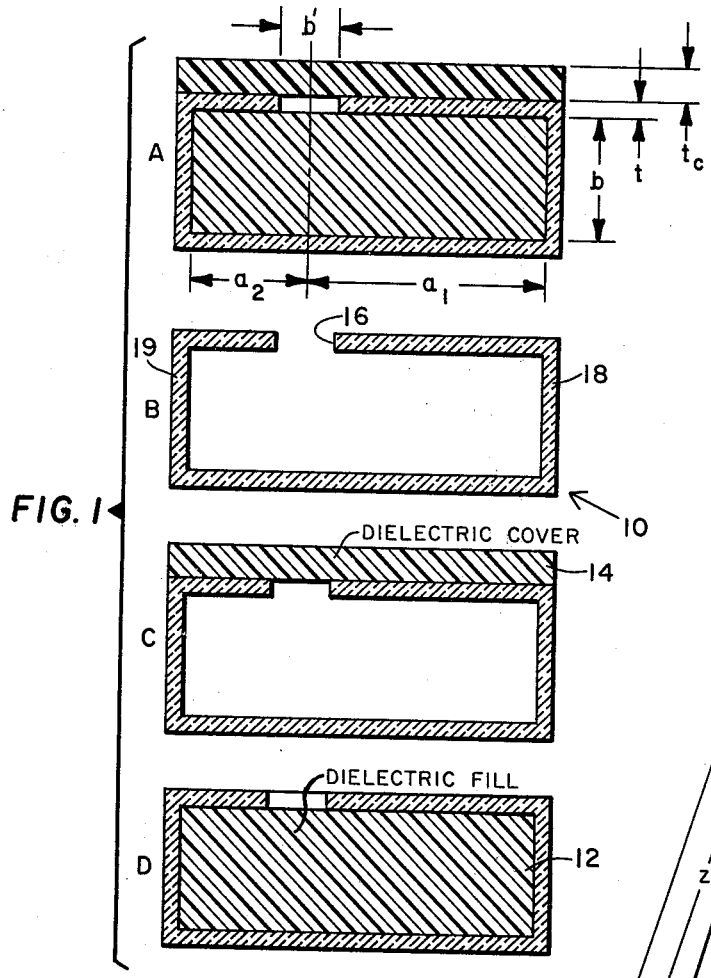
FIG. 1 shows four types of cross-sections for an antenna of the present invention.

In FIG. 1A of the drawing a cross-section 10 of the waveguide antenna is shown with both a dielectric waveguide fill 12 and a dielectric cover 14. FIG. 1B shows an antenna cross-section without fill or cover. FIG. 1C shows a cross-section with cover only, and FIG. 1D shows a cross-section with fill only.

Figure 2:
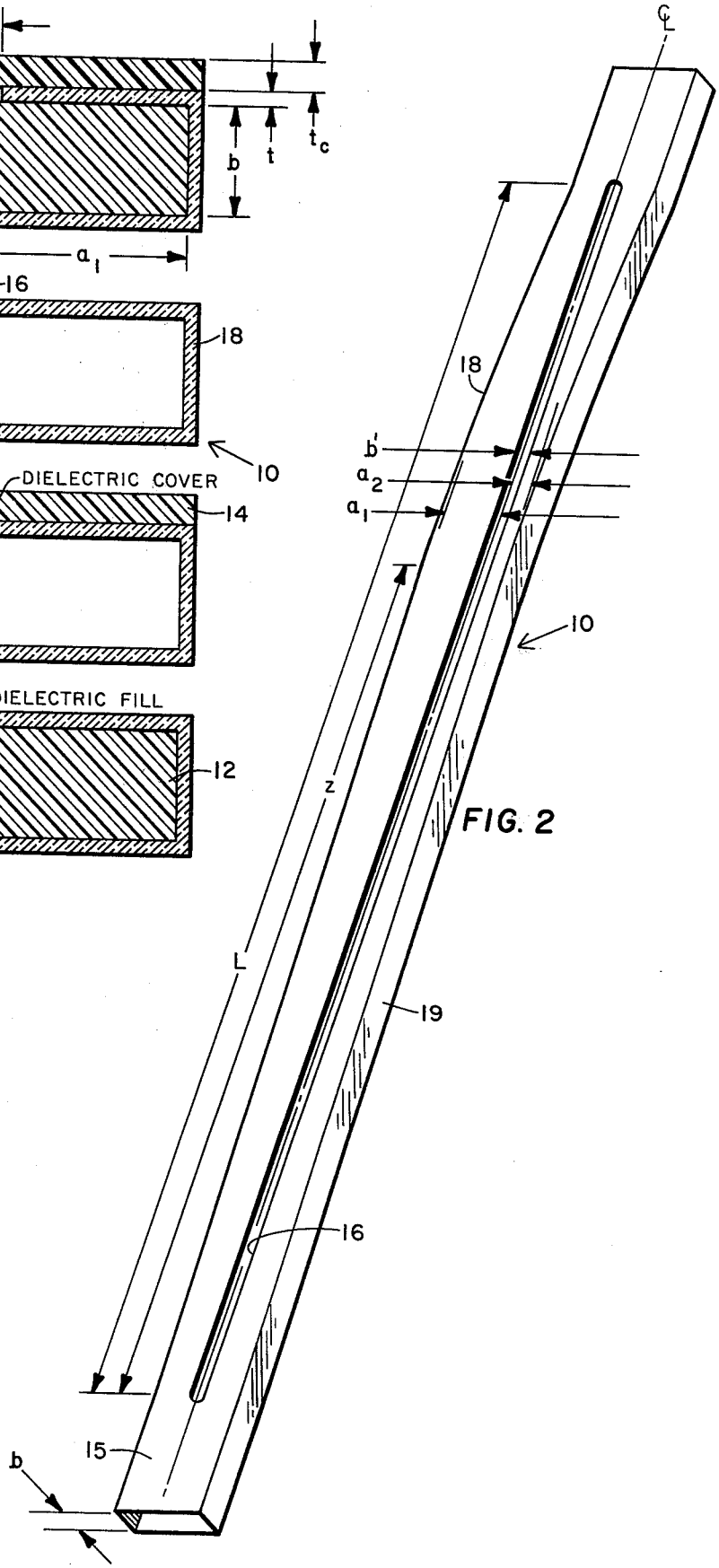
FIG. 2 shows a typical configuration for the waveguide antenna and also defines the dimensions.

The presence of either dielectric waveguide fill 12 or a dielectric cover 14 or both of specific thickness and conductivity have not previously been considered in equations contributing to the design. FIG. 2 shows the configuration of the waveguide antenna and defines the dimensions; a dielectric cover or fill is not shown in this figure.

A section of waveguide 15 has a straight slot 16 along the centerline thereof. The sides 18 and 19 of the antenna curve toward and away from the centerline respectively along the length of the 16 slot in accordance with specific equations hereinafter described.

The fixed dimensions for a particular antenna design are,

L=length of the straight radiating slot
b=inner height of waveguide
b'=width of radiating slot
t=thickness of wall containing radiating slot
$t_c$ =thickness of dielectric cover, where used Values must be given for, λ=wavelength of radiated energy
$\epsilon_c$=dielectric constant of waveguide cover
$\epsilon_w$=dielectric constant of waveguide fill
$\beta_z$=constant value of phaze
EFF=efficiency I(z)=current within the waveguide as a function of z, the distance along the aperture.

$a_1$ and $a_2$ are the inside distances from the center line of the slot to sidewalls 18 and 19 respectively.

The basic equation to be solved for $a_1$ and $a_2$ for a selected number of values of z is the "transverse resonance" equation which is written as, $$iZ' = \tan[(a_1 - t_i)\cdot k_x] + \tan[a_2 - t_i)\cdot k_x] \quad (1)$$

where iZ' is the complex impedance.

Z' and $k_x$ are complex quantities in the mathematical sense, and further as $a_1$ and $a_2$ are changed so are Z' and $k_{x'}$ thus the solution of equation 1 for $a_1$ and $a_2$ is not straightforward.

$t_i$ is an imaginary reference plane within the waveguide from which impedances are measured; $t_i$ is defined in equation (20) below. Such imaginary reference planes are discussed in WAVEGUIDE HANDBOOK by N. Marcuvitz, McGraw Hill 1951, sections 3.3 and 6.1.

The solution is accomplished by considering the real and imaginary parts of equation 1 as two separate real equations, and using a two variable Newton-Raphson iteration for $a_1$ and $a_2$.

It should be understood that the only practical method of performing the calculations presented here is by the use of a high speed digital computer.

The antenna of FIG. 2 is based, for example, on the following inputs,

L=12 inches
λ=1.3 inches
b=0.2 inches
t=0.005 inches
b'=0.150 inches
$\beta_Z$=3.41
$\epsilon_w$=1.07:$\epsilon_c$=1.0:$t_c$=0.
EFF=0.95

$$I = 1 - 2.2673x^2 + 0.5079x^4 + 13.267x^6 - 53.041x^8 + 95.946_x^{10} - 81.773x^{12} + 26.36x^{14}, -1 \leqq x \leqq 1,$$

where x is the distance from the midpoint of the aperture.

At each cross section point for which dimensions are required, the following sequence of calculations must be made for each iteration in the solution of equation 1.

$$a = a_1 + a_2 \quad (2)$$

$$\lambda_g = 2a \quad (3)$$

$$\alpha_z = \frac{I^2(z)}{2L\left[1 - EFF \int_0^z I^2(z)dz\right]} \quad (4)$$

$$Z_o = 754\left(\frac{b}{a}\right)\left(\frac{\lambda_g}{\lambda}\right) \quad (5)$$

$$Y_o = \frac{1}{Z_o} \quad (6)$$

$$\epsilon + b'/2b \quad (7)$$

$$A_o = \frac{2b'}{\lambda_g}\left(\tan^{-1}\left(\frac{1}{\epsilon}\right) + \frac{\ln\sqrt{1+\epsilon^2}}{\epsilon}\right) \quad (8)$$

-continued $$B_c = \lambda_g/2\pi b' \tag{9}$$

$$\gamma = e^{\frac{-2\tan-1(\epsilon)}{\epsilon}} \tag{10}$$

$$A_1 = \frac{-2\epsilon\gamma}{\pi}\left\{1 + \frac{5+\epsilon^2}{4(1+\epsilon^2)} + \left[\frac{4}{(1+\epsilon^2)} + \left(\frac{5+\epsilon^2}{1+\epsilon^2}\right)^2\right]\cdot\frac{\gamma^2}{9}\right\} \tag{11}$$

$$A_2 = 2\left\{\epsilon\tan^{-1}\left(\frac{1}{\epsilon}\right) + \frac{\tan^{-1}(\epsilon)}{\epsilon} + \ln\left(\frac{1+\epsilon^2}{4\epsilon}\right) - \frac{\pi(1+\epsilon^2)}{6\epsilon}\right\} - A_1 \tag{12}$$

$$B_d = \frac{b}{\lambda_g}\left(\frac{\pi}{3\epsilon} + A_2\right) \tag{13}$$

$$B_b = \frac{A_o}{2} - \frac{b}{\lambda_g}\left(\frac{\pi\epsilon}{3} + A_1\right) \tag{14}$$

$$A_a = A_o - 2(B_b + B_c) \tag{15}$$

$$A_c = \frac{b'}{b}(B_d - B_c) \tag{16}$$

$$A_b = \frac{2b'}{b}(B_c)^2 - A_aA_c \tag{17}$$

$$t_c = \frac{\lambda_g}{2\pi}\tan^{-1}\left(\frac{A_oA_a + 1}{A_oA_b - A_c}\right) \tag{18}$$

$$m^2 = \frac{2b}{b'}\cdot\frac{(1 + A_oA_a)^2 + (A_c - A_oA_b)^2}{(1 \pm A_o^2)(A_b + A_aA_c)} \tag{19}$$

$$t_i = \frac{b'}{2} - \frac{\lambda_g}{2\pi}\tan^{-1}(A_o) \tag{20}$$

$$b_i = \frac{(1 - A_o^2)(A_a - A_bA_c) + A_o(A_a^2 + A_b^2 - A_c^2 - 1)}{2[(1 + A_oA_a)^2 + (A_c - A_oA_b)^2]} \tag{21}$$

$$\alpha = 2\pi/\lambda \tag{22}$$

$$k = \alpha\sqrt{\epsilon_w} \tag{23}$$

$$a_i = a - 2t_i \tag{24}$$

$$F_w = \sqrt{1 - (\epsilon_w - 1)\left(\frac{2a_i}{\lambda}\right)^2} \tag{25}$$

$$F_c = \sqrt{1 - (\epsilon_w - \epsilon_c)\left(\frac{2a_i}{\lambda}\right)^2} \tag{26}$$

$$Y_{os} = \frac{b}{b'}\cdot Y_o \tag{27}$$

$$k_Z = \beta_Z - i\alpha_Z \tag{28}$$

$$k_x = F_w\sqrt{k^2 - k_Z^2} \tag{29}$$

-continued $$G_{ee} = \int_o^{b'k_x} J_o(x)dx - J_1(b'\cdot k_x) \tag{30}$$

where $J$ is the Bessell function $$B_{ee} = -\int_o^{b\cdot k_x} N_o(x)dx + N_1(b'k_x) + \frac{2}{\pi}\left(\frac{1}{b'\cdot k_x}\right) \tag{31}$$

where $N$ is the Neumann function $$B_{ec} = i\left[1 - \left(\frac{F_c}{F_w}\right)\cdot\frac{1 + i\left(\frac{F_c}{F_w}\cdot\tan\left(\frac{\pi F_c t_c}{a_i}\right)\right)}{\left(\frac{F_c}{F_w} + i\tan\left(\frac{\pi F_c t_c}{a_i}\right)\right)}\right] \tag{32}$$

$$Z_e = F_w\cdot\frac{G_{ee} + i[B_{ee} + B_{ec} + \tan([t + t_e]k_x)]}{1 + i[G_{ee} + i(B_{ee} + B_{ec})]\cdot\tan([t + t_e]k_x} \tag{33}$$

$$G_e = \mathrm{REAL}(Z_e) \tag{34}$$

$$B_e = \mathrm{IMAG}(Z_e) \tag{35}$$

$$G = \frac{Y_{o,s}}{m^2}\cdot G_e \tag{36}$$

$$B = \frac{Y_{o,s}}{m^2}\cdot B_e + Y_ob_i \tag{37}$$

$$X' = Y_o\cdot\frac{B}{G^2 + B^2} \tag{38}$$

$$R' = Y_o\frac{G}{G^2 + B^2} \tag{39}$$

$$Z' = R' - iX' \tag{40}$$

$$iZ' = X + iR' \tag{41}$$

Equations 7 through 21 give the parameters necessary to describe the equivalent circuit for calculating the impedance through the junction of the slot with the waveguide. Equations 30 and 31 give the parameters necessary to describe the equivalent circuit for a parallel plate guide radiating into half space. See Waveguide Handbook by N. Morewitz, Boston Technical Publishers, Inc., Boston, 1964, pages 337–338 and 184.

Arbitrary current functions can be imposed. Current synthesis techniques are presently available in which the main beam angle and side lobe level can be specified along with the wavelengths of the input energy, the length of the aperture, and constraints on the current at the ends of the aperture. As has been shown by the use of current synthesis techniques it is possible to generate particular currents which lead to specific desirable far field radiation patterns. Thus if a particular current function is to be imposed, an antenna with a predictable far field pattern can be built, as shown herein.

$\beta_Z$ is held constant. The current synthesis techniques presently in use assume that only the real part, $\alpha_Z$, of the waveguide impedance $\alpha_Z + i\beta_Z$ is affected by the current distribution, and that the imaginary component remains a constant. Thus, in order to build an antenna with a pattern which matches one predicted by the synthesized current distribution, the waveguide dimensions must be calculated in such a fashion that the value of $\beta_Z$ will remain the same as that used in the current synthesis.

Dielectric waveguide fill or covers or both, can be included in the calculations. Dielectric fills or covers may be desirable for structural purposes. Since either a fill or a cover will affect the radiation pattern it is necessary to include their effects in the calculations of the contours in order that the resulting pattern matches that predicted by the synthesized current.

What is claimed is:

1. A continuous-slot leaky-waveguide antenna in which arbitrary current functions can be imposed which leads to improved and predictable far E-field elevation patterns, comprising:

(a) a section of rectangular waveguide, (b) a long straight continuous slot cut in one broad face of said waveguide along the centerline passing through each end of said waveguide section, (c) at any point along the length of said straight slot one of the narrow sides of said waveguide section being offset to form a curve away from said centerline while the other narrow side of the waveguide being offset to curve toward said centerline, (d) the offset of each side and the total distance between said sides along the length of said slot being varied for adjusting the phase of energy radiated and determining the desired far E-field elevation pattern desired.

2. An antenna as in claim 1 wherein said waveguide section is completely filled with dielectric of desired dielectric constant.

3. An antenna as in claim 1 wherein said waveguide section is provided with a dielectric cover of a desired thickness and dielectric constant.

4. An antenna as in claim 1 wherein said waveguide section is provided with a dielectric cover of desired thickness and dielectric constant, and is completely filled with dielectric material of desired dielectric constant.

* * * * *